US007405647B2

(12) United States Patent
Rosche et al.

(10) Patent No.: US 7,405,647 B2
(45) Date of Patent: Jul. 29, 2008

(54) TIMING FOR TAKING MEDICATION INCLUDING A CAP ATTACHABLE TO A RECEPTACLE

(75) Inventors: Roger M. Rosche, Singapore (SG); Han Kort, Singapore (SG)

(73) Assignee: Remind Cap Pte. Ltd., Singapore (SG)

( * ) Notice: Subject to any disclaimer, the term of this patent is extended or adjusted under 35 U.S.C. 154(b) by 681 days.

(21) Appl. No.: 10/164,722

(22) Filed: Jun. 7, 2002

(65) Prior Publication Data

US 2004/0201458 A1 Oct. 14, 2004

(51) Int. Cl.
*G08B 1/00* (2006.01)

(52) U.S. Cl. ..... 340/309.16; 340/309.7; 340/929; 215/219; 215/230

(58) Field of Classification Search ..... 340/309.16, 340/309.7, 309.8, 309.9, 322, 7.38, 929, 340/825.19; 123/146.5 A; 215/219, 230
See application file for complete search history.

(56) References Cited

U.S. PATENT DOCUMENTS

| | | | |
|---|---|---|---|
| 3,921,568 | A | 11/1975 | Fish |
| 4,065,916 | A | 1/1978 | Leuschner |
| 4,361,408 | A | 11/1982 | Wirtschafter |
| 4,367,955 | A | 1/1983 | Ballew |
| 4,419,016 | A | 12/1983 | Zoltan |
| 4,483,626 | A | 11/1984 | Noble |
| 4,588,303 | A | 5/1986 | Wirtschafter et al. |
| 4,589,780 | A | 5/1986 | Takebe |
| 4,725,997 | A | 2/1988 | Urquhart et al. |
| 4,748,600 | A | 5/1988 | Urquhart et al. |
| 4,768,176 | A | 8/1988 | Kehr et al. |
| 4,768,177 | A | 8/1988 | Kehr et al. |
| 4,837,719 | A | 6/1989 | McIntosh et al. |
| 4,939,705 | A | 7/1990 | Hamilton et al. |
| 4,971,221 | A | 11/1990 | Urquhart et al. |
| 5,016,230 | A | 5/1991 | Seifers et al. |
| 5,233,571 | A | 8/1993 | Wirtschafter |
| 5,313,439 | A | 5/1994 | Albeck |

(Continued)

FOREIGN PATENT DOCUMENTS

| | | |
|---|---|---|
| DE | 26 03 248 B1 | 1/1976 |

(Continued)

OTHER PUBLICATIONS

"Adultproof Cap: A way to Keep Patients Honest," Time, Jun. 5, 1989.

*Primary Examiner*—Daniel Wu
*Assistant Examiner*—Daniel Previl
(74) *Attorney, Agent, or Firm*—Fish & Richardson P.C.

(57) ABSTRACT

A device includes a cap attachable to a receptacle for co-acting therewithin enclosing medication and timing a predetermined interval for taking the medication defined by one timing schedule of a set of selectable timing schedules. An electronic timing circuit is constructed and arranged to provide an alarm signal designating a time for taking the medication at the expiration at a predetermined time interval defined by the timing schedule. The electronic timing circuit is housed in the cap and includes schedule processing circuitry that defines the set of selectable timing schedules, and a set of outputs for issuing electrical signals at the expiration of the predetermined time interval. The device has a top part that fits snuggly inside the cap and remains attached to the cap under normal circumstances.

1 Claim, 8 Drawing Sheets

U.S. PATENT DOCUMENTS 5,449,078 A 9/1995 Akers
5,638,970 A * 6/1997 Garby et al. ..... 215/219
5,765,706 A * 6/1998 Barker et al. ..... 215/230
5,850,344 A 12/1998 Conkright
5,938,055 A 8/1999 Philips et al.
5,984,122 A * 11/1999 Barker et al. ..... 215/230
6,084,504 A * 7/2000 Rosche et al. ..... 340/309.7

FOREIGN PATENT DOCUMENTS

EP 0 407 178 A2 1/1991
EP 0 407 178 B1 1/1991
WO WO80/00766 4/1980

* cited by examiner

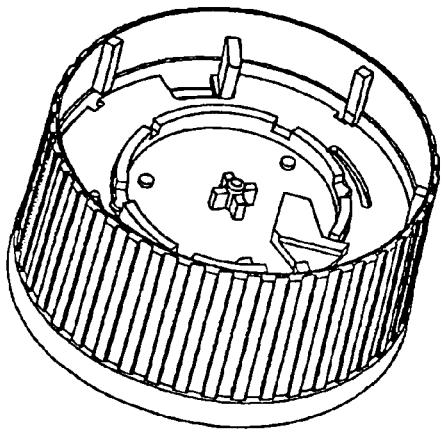
FIG. 7A
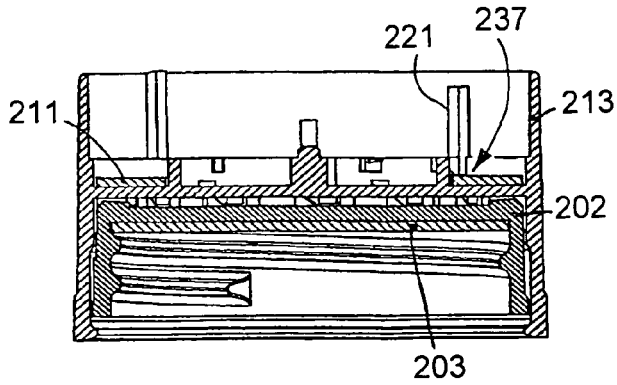
FIG. 7B
FIG. 8
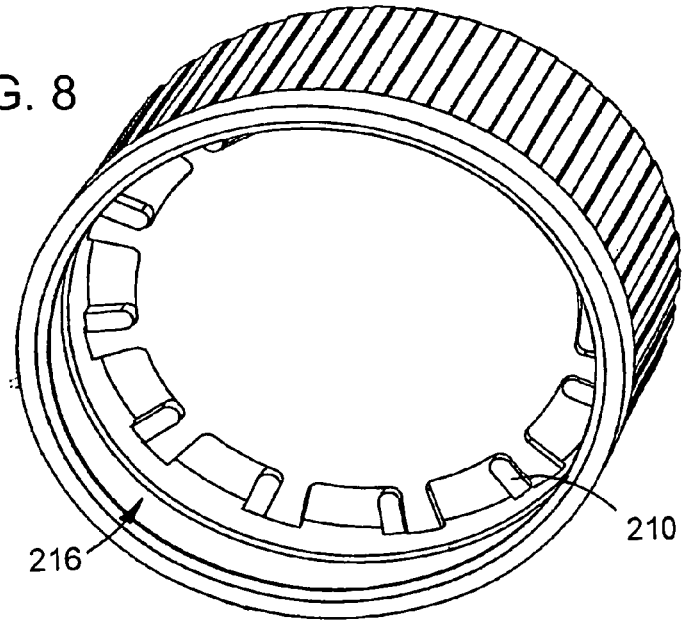

TIMING FOR TAKING MEDICATION INCLUDING A CAP ATTACHABLE TO A RECEPTACLE

This invention relates to timing, and more particularly to improved methods and apparatus for providing repetitive timed events.

BACKGROUND

For background, reference is made to U.S. Pat. No. 6,084,504 of Rosche et al. and U.S. Pat. No. 5,016,230 of Monte Seifers et al., both entitled TIMING.

BRIEF SUMMARY OF THE INVENTION

One aspect of the invention is an improved device that is attachable to a receptacle for timing a predetermined interval according to a timing schedule of a set of timing schedules. The device has an electronic timing circuit that provides an alarm signal at the expiration of the predetermined time interval. The timing circuit includes a set of inputs and a set of outputs that are both connected to processing circuitry. The inputs correspond to the timing schedules, and the outputs issue the alarm signals.

Embodiments of this aspect of the invention include one or more of the following features.

The sensing mechanism is in mechanical communication with the inputs, and the sensing mechanism changes position in response to a nonfrictional normal force. A selector mechanism allows the timing schedules to be mechanically selected.

The details of one or more embodiments of the invention are set forth in the accompanying drawings and the description below. Other features, objects, and advantages of the invention will be apparent from the description and drawings, and from the claims.

BRIEF DESCRIPTION OF THE SEVERAL VIEWS OF THE DRAWING

FIG. 7A is a perspective view of a subassembly to the top of the housing including the trigger, inner closure and seal;

FIG. 7B is a diametrical sectional view of the assembly of FIG. 4;

FIG. 8 is a perspective bottom view of a subassembly of the housing and trigger of FIG. 4;

DETAILED DESCRIPTION

Figure 1:
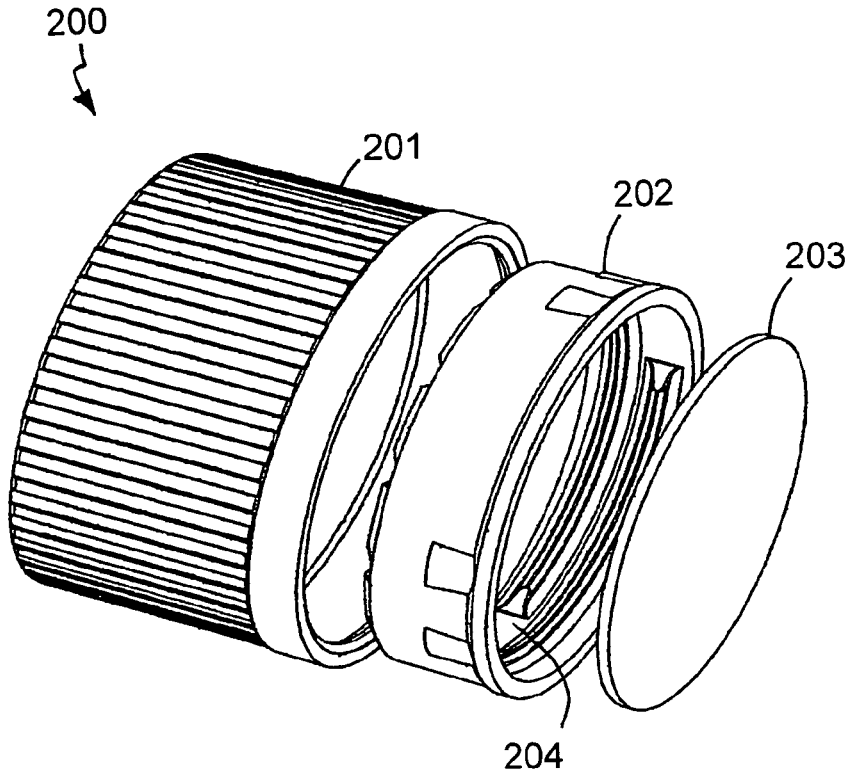
FIG. 1 is an exploded view of a cap corresponding substantially to that disclosed in U.S. Pat. No. 6,084,504 along a longitudinal axis extending through the cap.

Referring to FIG. 1, there is shown a child-resistant cap 200 for closing medicine containers. This cap 200 has three different plastic parts, the "OUTER PART 201, " the "INNER CLOSURE" 202 and a seal plate 203. The "INNER CLOSURE" 202 has inside thread connection 204 to fit on the medicine container and is fitted in the "OUTER PART" 201. The "INNER CLOSURE" 202 can rotate freely inside the "OUTER PART" 201. Cap 200 may be closed by rotating cap 200 till the end of inside thread connection 204 of "INNER CLOSURE" 202 fully engages that at the end of the medicine container. To open cap 200, rotate in opposite direction. When there is no axial pressure on existing cap 200, cap 200 can rotate freely. To open cap 200, press hard in axial direction together with rotating torque force. The required combination of pressing and rotating to open is difficult.

Figure 2A:
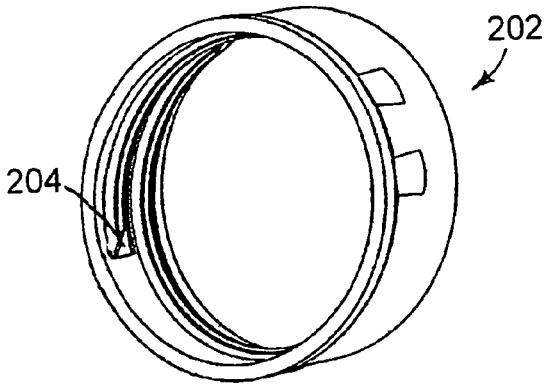
FIGS. 2A and 2B are perspective views of the inner closure of FIG. 1.
Figure 2B:
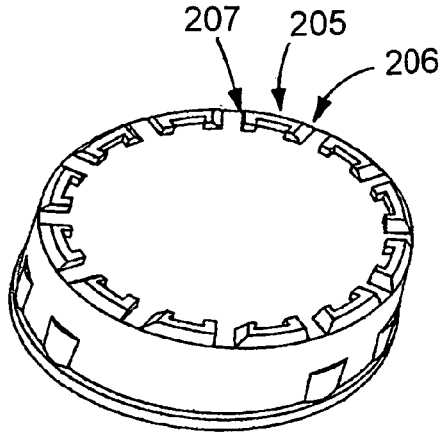

The inner closure 202 with inside thread connection 204 can rotate in outer part 201. This inner closure 202 is locked in the outer part 201 and cannot exit but can rotate freely inside. Referring to FIG. 1 and FIG. 2, at the top of the plastic inner closure 202 are mounted special ridges 205. All these ridges 205 are at one side 206 sloped and at the other side 207 straight. Inside outer part 201 there are also opposite other ridges. These ridges are between the ridges of the thread part 205. For closing the cap 200 the ridges of outer part 201 may be pressed to the straight surface 207 of ridges 205 at inner closure 202. By rotating for opening cap 200 the ridges inside the outer part 201 will be pressed to the sloped surface 206 of ridges 205 of the inner closure 202. Normally these ridges of outer part 201 will not grip the opposite sloped surface 206. By pressing hard longitudinally to cap 200, the ridges of outer part 201 can furnish enough friction to force ridges 205 of the inner closure to rotate inner closure 202 to open cap 200 of the medicine container normally.

Inside the threaded part a thin seal plate 203 closes the open top of the medicine container.

Figure 3:
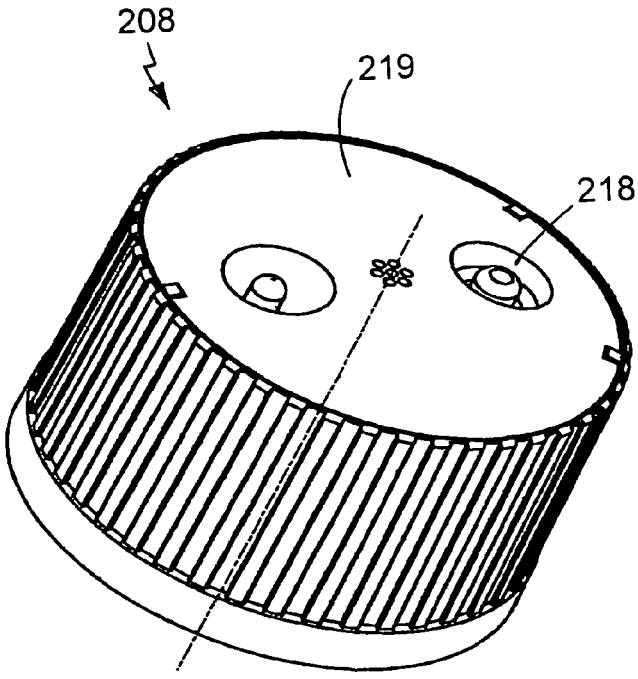
FIG. 3 is a perspective view of a cap according to the invention.

FIG. 3 shows cap 208 with timing structure according to the invention with the same inner closure 202 and seal plate 203.

Figure 5A:
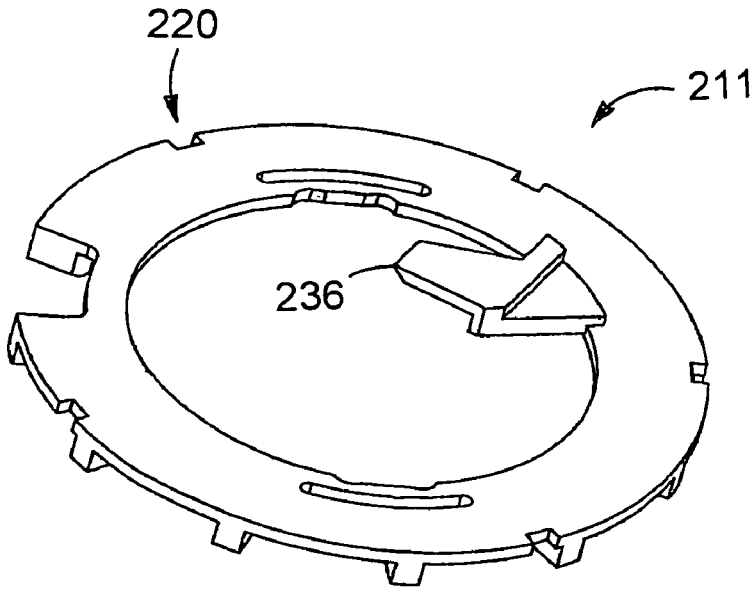
FIGS. 5A and 5B are perspective views of the top and bottom side of the trigger of FIG. 4.
Figure 5B:
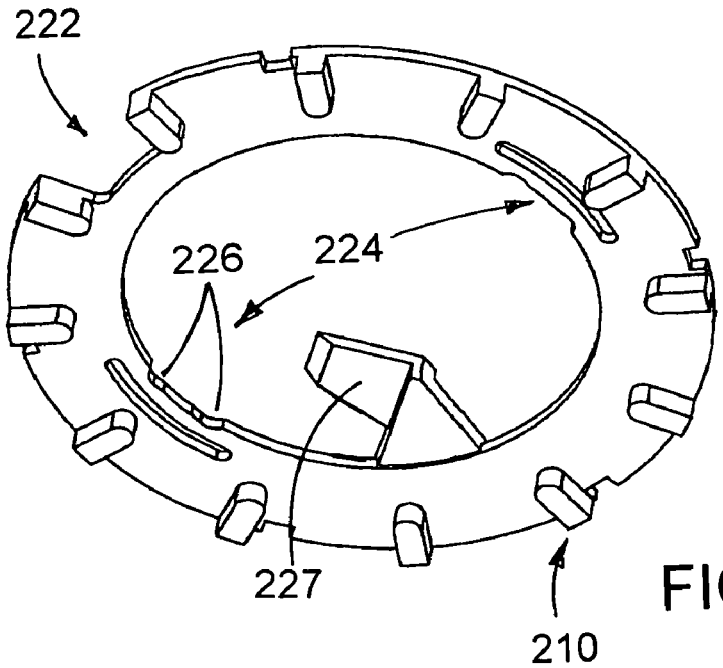
Figure 6A:
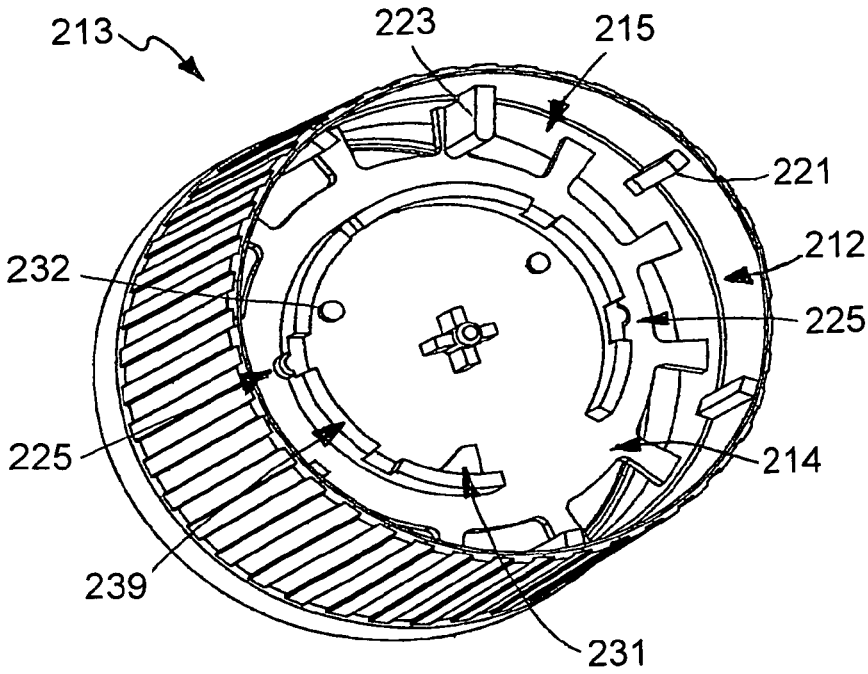
FIGS. 6A and 6B are perspective views of the top and bottom side of the housing of FIG. 4.
Figure 6B:
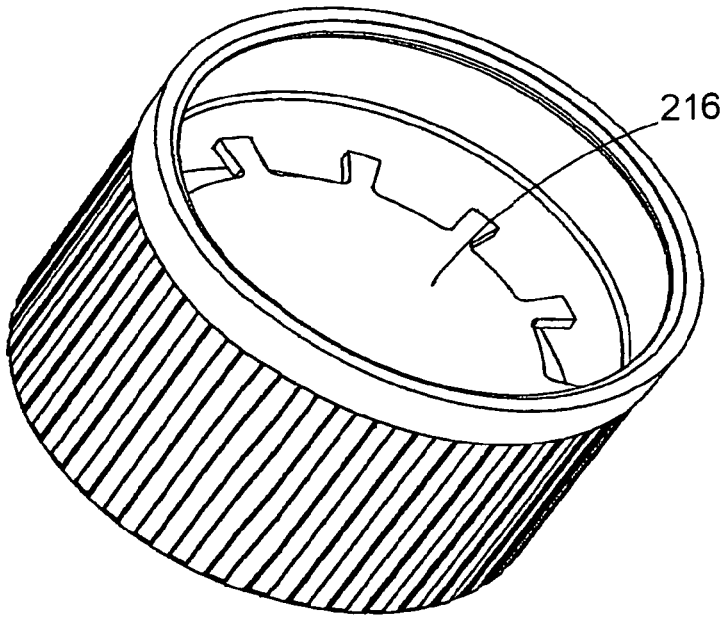

The ridges in outer part 201 of cap 200 normally can rotate a small angle in cap 208. The opposite ridges 205 will grip ridges 210 of the trigger 211, see FIG. 5 and FIG. 8. This trigger 211 is in the topside 212 of the main housing 213 of FIG. 6 and can rotate inside at the bottom 214 of the main housing 213. The ridges 210 stitch through the open sleeves 215 of the bottom 214 of the main housing 213. Visible at inner side 216 where the inner closure 202 is placed into the main housing 213 is the reference arrangement of FIG. 8, the same as with the cap 200.

The main housing 213 has two inner parts. One is bottom opening 216. A second is the top opening 212. The bottom opening 216 is exactly the same as the opening of the existing outer part 201. For the assembly, the inner closure 202 is pressed in the outer part 201 as well as the bottom opening 216 of main housing 213. After pressed in the inner closure 202, this structure can rotate freely in the main housing 213.

Figure 4:
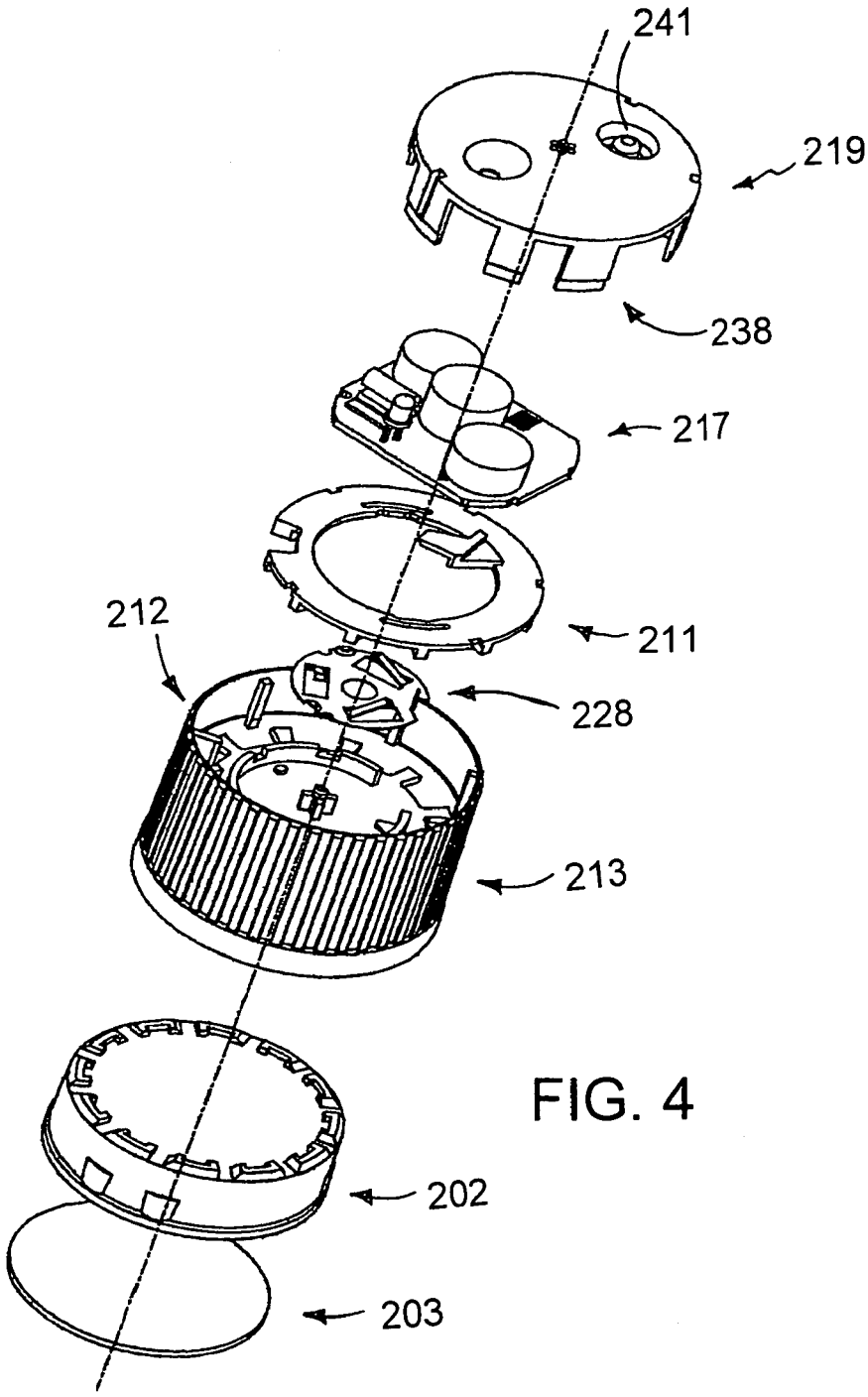
FIG. 4 is an exploded view of the top of the housing with the trigger, inner closure, seal, timing device and top part, exploded along a longitudinal axis extending through the cap of FIG. 3.

The second top opening 212 is for placing the trigger 211 and the timing device 217, including the reset button 218 and closing by the top part 219, see FIGS. 3 and 4.

The trigger 211 may be placed at the bottom 214 of the main housing 213. When this trigger 211 is placed in the main housing 213, small sleeves 220 in the outer diameter of the trigger 211 will be guided over the ridges 221 inside the main housing 213. For the proper orientation of the trigger 211 the sleeve 222 is placed around the position ridge 223 in the main housing 213. The trigger 211 can make a free small rotation, driven by the inner closure 202 at the other side of the bottom 214.

The inner closure 202 is free to rotate inside the main housing 213. The trigger 211 always has some restriction in rotation. If the medicine container is closed with cap 208, in the last part of the thread connection 204, the trigger 211 is rotated in a closed position. When starting to open the cap 208, the trigger 211 is rotated first in the open position and than the inner closure 202 is fixed in the main housing 213 to open the cap 208 completely. Thus, trigger 211 rotates only in the last part of the thread connection 204, as well for closing as for opening cap 208. The rotate restrictions 224 of the trigger 211 work together with two bumps 225 at the bottom 214 of the main housing. These bumps 225 fall in two free separate sleeves 226 in the trigger 211. The open and close position of the trigger 211 are made by these two free position sleeves 226. Between these sleeves there is a restriction connection 224. When the bumps 225 pass these restriction connections 224, these restrictions 224 will be bent in slightly. This gives automatically some restriction by rotation of the trigger 211.

Figure 11:
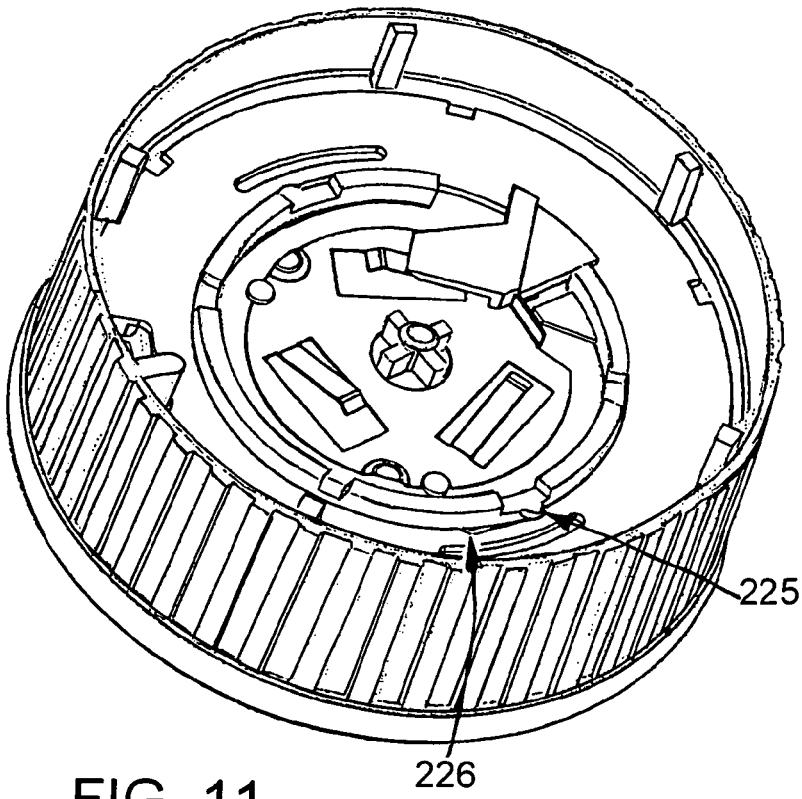
FIG. 11 is a perspective view inside the housing with the trigger plate of FIG. 7.

FIG. 11 shows the bump shape 225 in the free sleeve 226 positions. Two bumps positions 225 opposite each other provide for a good balance of the rotation of the trigger 211 in the main housing 213.

The trigger 211 also has ramp 227 to make a switch connection to the timing device 217.

Figure 9A:
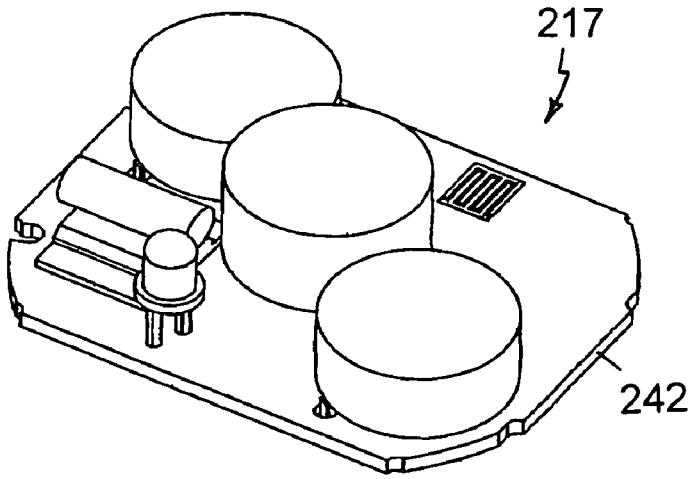
FIGS. 9A and 9B are perspective views of the bottom and top of the timing device with components of FIG. 4.
Figure 9B:
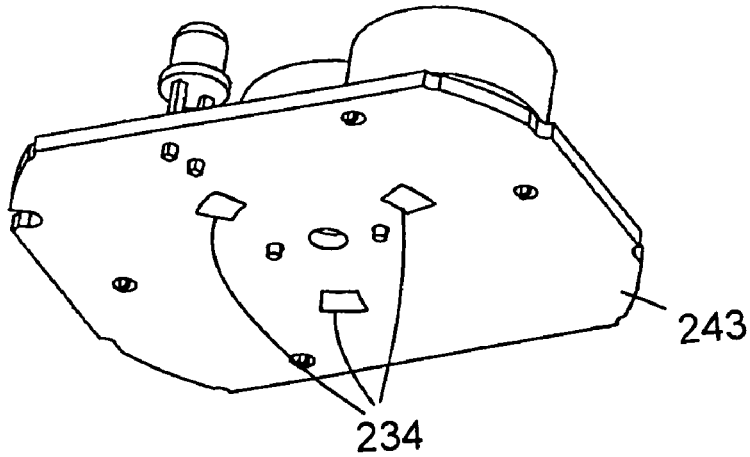
Figure 10:
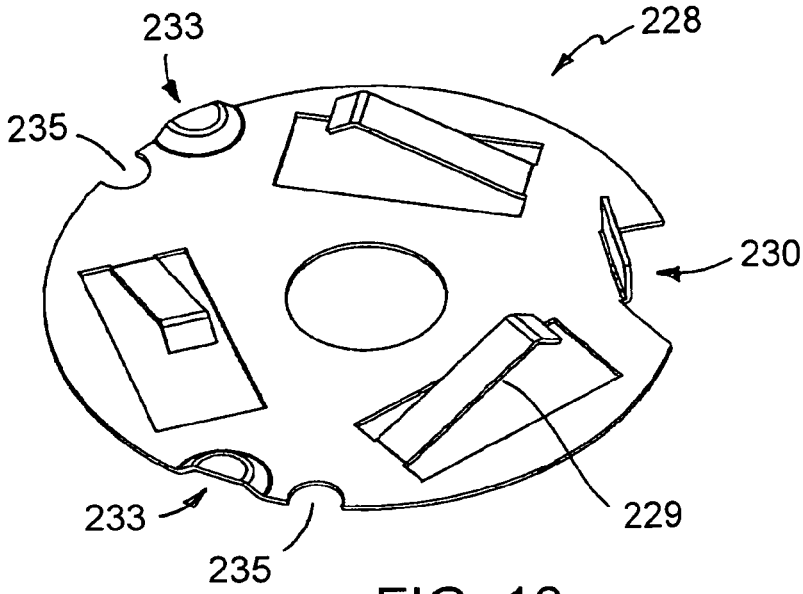
FIG. 10 is a perspective view of the activation contact of FIG. 9.

In the center at the bottom 214 of the main housing 213 is a metal sheet contact 228, see FIG. 10 and FIG. 11. This metal sheet contact 228 activates the timing device 217 of cap 208 upon first opening. The metal sheet contact 228 has three angled bent contact lips 229 inside. It also has a straight bent lip 230. By assembling the metal sheet contact 228 in the main housing 213, a special shape 231 (FIG. 6) at the bottom 214, gives the position of this. Also two other small posts 232 are positioned underneath the two dimples 233 of the metal sheet contact. The position of the metal sheet contact 228 is in the off position. As soon as one opens the cap 208 for the first time, the trigger 211 with the ramp 227 will press the straight bent lip 230, and the metal sheet contact 228 will rotate. The three bent contact lips 229 now make a connection to three separate contacts 234 underneath the timing device (see FIG. 9). The timing device 217 is activated and placed in an open position. See FIG. 11. The two small posts 232 at the bottom 214 of the main housing 213 are now positioned in two small sleeves 235, so that this sheet metal contact 228 is fixed and cannot rotate. The metal sheet contact 228 has three bent contact lips 229. Two lips make the activation and one lip is for the on/off switch. When the cap will close the medical container, the trigger 211 will make a closed rotation, and a special lip 236 of the ramp 227 of the trigger 211 will bend the on/off contact downwards so that it will break the connection. By opening thereafter the cap 208, the lip 236 gives the on/off contact freedom to make contact again.

To open the cap 208 from the medical container, press hard longitudinally together with a rotation force. This longitudinal pressure to cap 208 will press all the forces to the trigger 211. This means that the trigger 211 is placed in a good longitudinal locked position n the main housing 213. This positioning is done by the surface 237 underneath the axial ridges 221 inside the main housing 213, together with the support ridges 238 of the top part 219.

The top part has underneath around the outer edge several support ridges 238. Some of these ridges 238 are for guiding and positioning in the main housing 213, other ridges are for snapping the top part 219 underneath some ridges 221 in the main housing 213. In combination ridges 238 will also lock the longitudinal position of the trigger 211 and fix the timing device 217.

The timing device 217 is supported normally to some ridges 239 at the bottom 214 of the main housing 213. There are also two position pins for positioning of the timing device 217 in the main housing 213, one in the center 240 and one ridge 223 in the sidewall. Key path button 241 is in the top part 219 (see FIG. 4). There is a small restriction so that the key path button 241 is fixed by the assembly process in the top part 219.

This timing device 217 is on a small printed board 242, and all components are mounted at one side of the board. The bottom side 243 is used for some switch possibilities 234, for the on/off contacts and for the activation of the cap 208. The board 242 is relatively small and compact.

The chip is programmable for signalling only once a day, twice, thrice or four times a day. Also other settings can be programmed in the chip.

The invention has a number of features. It maintains the time. Thus, if set to alert daily at 8 AM, it will alert daily at 8 AM unless reset regardless of whether on a given day the unit is opened early or after the alert has been active for some time. If it is opened early within 12 hours for a once daily setting or within six hours for a twice a day setting, it will assume the user is opening to take the medication early and will skip the next scheduled alert. But it maintains the time so the following alert if the unit isn't opened will occur as originally activated.

For example, the user starts the alert cycle for once daily at 8 AM. The next day the user opens the unit at 7 AM. At 8 AM that day there will be no alert. The following day if not opened again, the alert will begin at 8 AM. Alternatively, the user opens the unit at 10 AM after the alert has been signalled for two hours. The unit will stop the alerting. If not opened again, the alert will start at 8 AM.

Pushing the reset or start tab or button on top resets the start of alert cycle. This reset only works when the alert is not active. If it is time to take the medication and unit is actively alerting, the user must first open the cap off the vial to presumably take the medication then and end the alert, prior to resetting the alert schedule.

The pharmacist by rotating the top and then snapping down activates the unit. Alternatively, the cap may be constructed and arranged so that first placing the cap on the vial activates the unit.

The unit after half the scheduled interval between alerts ends the alert and does not begin alerting again until the next scheduled alert.

The unit, when off the vial, preferably alerts silently, such as flashing without beeping. It then typically flashes during alerts for the following 48 hours without beeping. Holding down the reset or start button for four seconds will toggle between beeping during the alert cycles when the cap is on the vial and only flashing during those alert cycles if the toggle mute has been activated by the four-second depression of the reset or start button, observing the LED go from steady ON to rapid flashing and then releasing the button or tab. The first four-second depression produces a flash only alert without beeping in a silent mode. The second four-second depression ends with a beep.

In an exemplary embodiment trigger 211 functions as an interface between the inner closure 202 and the timing device 217 with ribs 207 and slopes 206 at the top of inner closure 206. It is within the principles of the invention to use other structures to produce relative rotation between the trigger and inner closure.

It is evident that those skilled in the art may now make numerous modifications of and departures from the specific apparatus and techniques herein disclosed without departing from the inventive concepts. Consequently, the invention is to be construed as embracing each and every novel concept and novel combination of concepts herein disclosed and limited only by the spirit and scope of the appended claims.

What is claimed is:

1. A timing device including a cap attachable to a receptacle for coacting therewith in enclosing medication and timing a predetermined interval for taking the medication defined by one timing schedule of a set of selectable timing schedules, the timing device comprising:

an electronic timing circuit constructed and arranged to provide an alarm signal designating a time for taking the medication at the expiration of a predetermined time interval defined by the timing schedule;

said electronic timing circuit on a circuit board being housed in said cap and including schedule processing circuitry that defines the set of selectable timing schedules, and a set of outputs for issuing electrical signals at the expiration of the predetermined time interval;

said device having a top part that fits snugly inside the cap;

said top part remaining attached to the cap under normal circumstances, said electronic timing circuit having three separate contacts on said circuit board underneath said timing device, a metal sheet contact formed with three bent contact lips constructed and arranged to make a connection to said three separate contacts when said cap is opened and thereby causes said metal contact to rotate to activate the timing device.

* * * * *